United States Patent [19]

Hahn

[11] Patent Number: 4,709,853

[45] Date of Patent: Dec. 1, 1987

[54] ADJUSTABLE PLATFORM MEANS

[75] Inventor: Ronald R. Hahn, Barrington, Ill.

[73] Assignee: Hahn Manufacturing Co., Franklin Park, Ill.

[21] Appl. No.: 790,390

[22] Filed: Nov. 21, 1985

[51] Int. Cl.[4] ..... B65D 91/00

[52] U.S. Cl. ..... 232/39; 248/146

[58] Field of Search ..... 232/38, 39; 248/146, 248/152, 158, 188.1

[56] References Cited

U.S. PATENT DOCUMENTS

| | | | |
|---|---|---|---|
| 949,231 | 2/1910 | Hanson | 248/146 |
| 1,603,595 | 10/1926 | Hansen | 248/158 X |
| 2,200,690 | 5/1940 | Elliott | 248/146 |
| 2,669,408 | 2/1954 | Cox | 248/146 |
| 2,781,964 | 2/1957 | Ledgerwood | 232/17 |
| 3,163,356 | 12/1964 | Joehnk | 232/35 |
| 3,243,104 | 3/1966 | Fillion | 232/33 |
| 3,465,994 | 9/1969 | Block | 248/130 |
| 3,833,168 | 9/1974 | Sackrison | 232/39 |
| 3,934,806 | 1/1976 | Rady | 248/188.1 X |
| 4,105,180 | 8/1978 | Hodge | 248/300 |
| 4,213,560 | 7/1980 | Hall | 232/39 |
| 4,236,665 | 12/1980 | Glass | 232/39 |
| 4,508,259 | 4/1985 | Hicks | 232/17 |

*Primary Examiner*—Robert P. Swiatek

*Attorney, Agent, or Firm*—Welsh & Katz, Ltd.

[57] ABSTRACT

A rural mailbox support includes a mailbox, a vertical support member and a base for mounting the vertical support member in the ground. One or more C-shaped members extend laterally from the vertical support, and have first and second extending arms extending laterally therefrom. The C-shaped members also have longitudinal slots in the extending arms. L-shaped brackets are provided for connecting the C-shaped base to the mailbox. The C-shaped brackets have locking tabs at each end adapted for insertion into the longitudinal slots and for reception of bolts so that the L-shaped brackets can be adjustably positioned for a variety of sizes of mailboxes, or other equipment.

16 Claims, 7 Drawing Figures

ADJUSTABLE PLATFORM MEANS

BACKGROUND OF THE INVENTION

This invention relates to adjustable supports for exterior fixtures such as mailboxes and birdbaths.

In the manufacture and sale of support devices for residential use, it is highly desirable to provide a single multi-adjustable device for use with a variety of applications by a do-it-yourselfer, for example, for use and attachment to a mailbox, a birdbath, a birdfeeder, a statue, a newspaper holder, signage, or the like. In addition, it is highly desirable to provide a device in which the position of the object being supported is adjustable both in vertical and horizontal planes.

Accordingly, it is an object of the present invention to provide an adjustable platform mechanism and support stand for use, in particular, with exterior household fixtures such as mailboxes. It is an additional object of the invention to provide a bracket mechanism to use with mailboxes and other household applications.

SUMMARY OF THE INVENTION

The present invention includes a supporting device for residential equipment such as mailboxes, birdfeeders and the like. The invention comprises a vertical support, usually in the form of a pair of extruded aluminum tubes having a brace inbetween them which supports a box on the top surface thereof. A base is provided for mounting the vertical support in the ground. One or more C-shaped members extend laterally and oppositely from the vertical support member. The C-shaped members each have first and second extending arms and one or more longitudinal slots or apertures in the arms. One or more L-shaped bracket members are connected to the extending arms. Each L-shaped bracket member has one or more longitudinal bracket slots formed therein and one or more locking tabs extending normally from both the proximal and distal ends thereof for insertion into and engagement with the longitudinal slot in the extending arms. The L-shaped brackets in turn are attached to the C-shaped members by means of, for example, nuts and bolts or other fastening and gripping means through both the longitudinal slots and longitudinal bracket slots. As a result the positioning of the L-shaped members relative to the C-shaped members, and thereby the vertical support, is adjustable both horizontally and vertically. An adjustable platform is thereby provided.

BRIEF DESCRIPTION OF THE DRAWINGS

This invention can be most clearly described and illustrated with reference to the attached drawings. While of necessity, certain limitations must be present in such descriptions, no intention is meant thereby to limit the generally broad scope of this invention.

DETAILED DESCRIPTION OF THE PREFERRED EMBODIMENT

Figure 1:
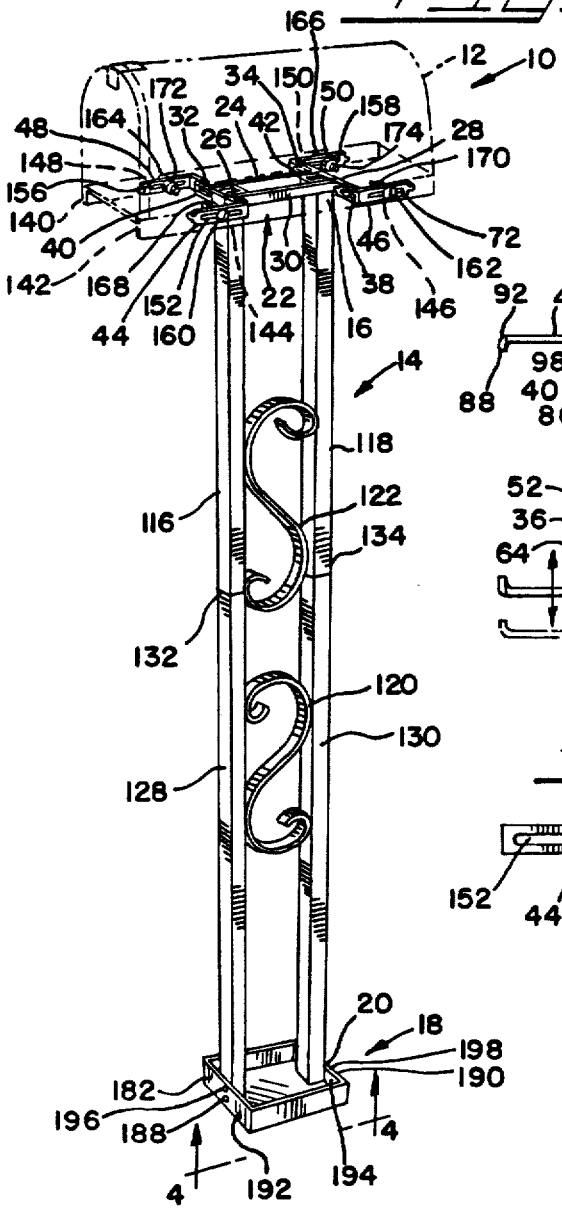
FIG. 1 of the drawings is a front perspective view of a mailbox and support of the present invention.

While the present invention is susceptible of embodiment in many different forms, there is shown in the drawings and will herein be described in detail several specific embodiments with the understanding that the invention is not limited thereto except insofar as those who have the disclosure before them are able to make modifications and variations therein without departing from the scope of the invention.

Referring particularly to FIG. 1, a mailbox and support 10 are shown which comprise a mailbox member 12 having a vertical support 14. Mailbox 12 is supported on the distal end 16 of the vertical support 14. A base 18 is mounted on the proximal end 20 of the vertical support member 14 for mounting on the ground. Two generally C-shaped base members 22 and 24 extend laterally from the vertical support member 14 and extend oppositely from each other. The C-shaped base member 22 has a first extending arm 26 and a second extending arm 28 which extend perpendicularly from the center portion 30. Similarly, first extending arm 32 and a second extending arm 34 extend perpendicularly from the second C-shaped base member 24. A longitudinal slot 36 is formed in the first extending arm 26. Similarly, a longitudinal slot 38 is formed in second extending arm 28. More than one longitudinal slot may be formed in each of the extending arms if desired. A longitudinal slot 40 is formed in the third extending arm 32. A longitudinal slot 42 is also formed in fourth extending arm 34.

Figure 2:
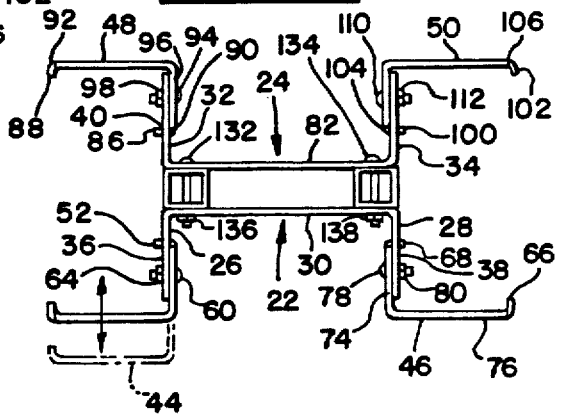
FIG. 2 of the drawings is a top view of the support of FIG. 1 of the drawings.
Figure 3:
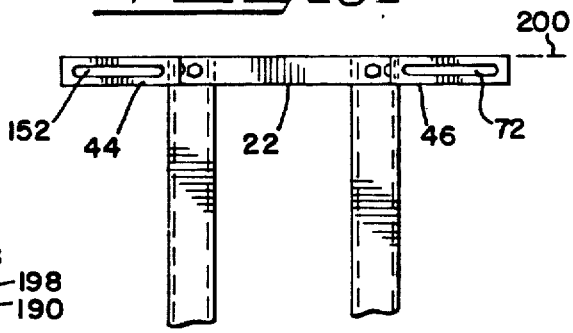
FIG. 3 of the drawings is a front view, of the top portion of the support of FIG. 1 of the drawings.
Figure 5:
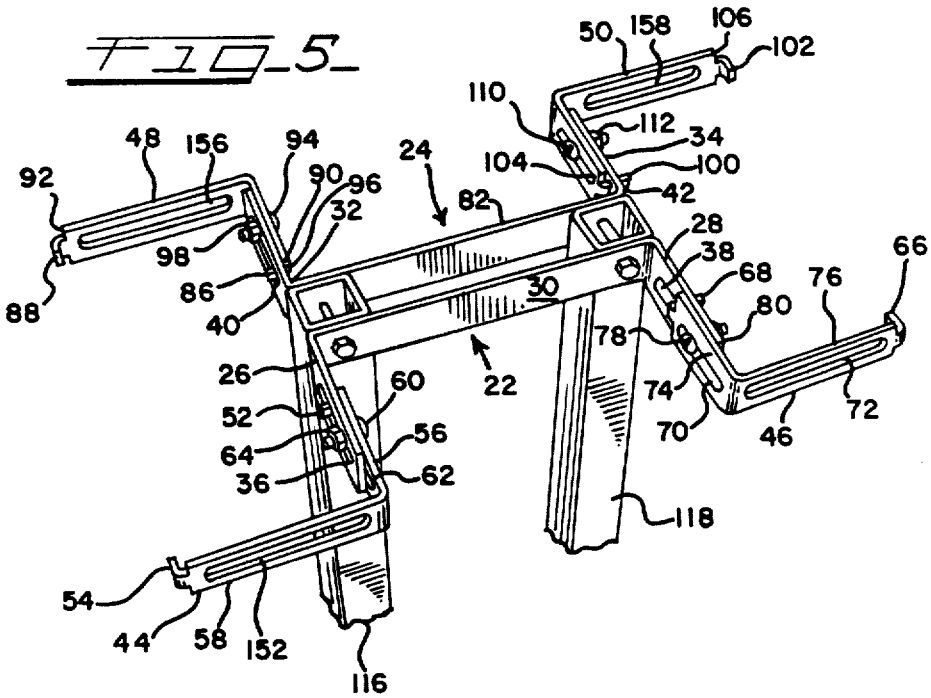
FIG. 5 of the drawings is a front perspective view of the top portion of the support of FIG. 1 of the drawings.
Figure 6:
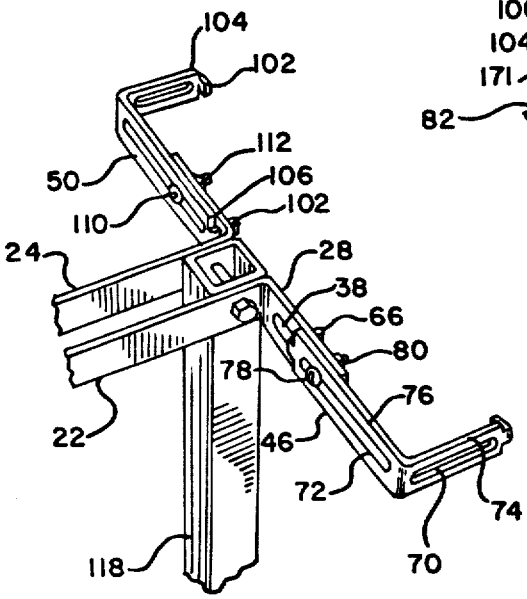
FIG. 6 of the drawings is a front perspective view of one portion of the top of the support of FIG. 1 of the drawings, showing in particular L-shaped brackets mounted in an extended position.
Figure 7:
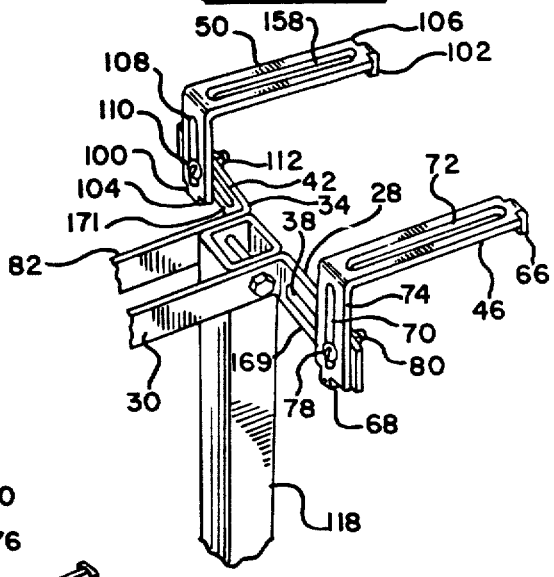
FIG. 7 of the drawings is a front perspective view of one portion of the top of the support of FIG. 1 of the drawings, showing in particular the L-shaped brackets mounted in a vertical position.

As best seen in FIGS. 5–7 of the drawings, extending from the C-shaped base member 22 are L-shaped brackets members 44 and 46. Similarly, extending from the C-shaped base member 24 are two generally L-shaped bracket members 48 and 50. The L-shaped bracket 44 has a pair of locking tabs 52 and 54 which extend normally from arms 56 and 58 of L-shaped bracket member 44. Tabs 52 and 54 are adapted for insertion into longitudinal slot 36 so as to allow slidable positioning of L-shaped bracket 44 relative to first extending arm 26. L-shaped bracket member 44 is attached to first extending arm 26 by means of fastening means such as bolt 60, which extends through longitudinal bracket slot 62, and through longitudinal slot 36. Bolt gripping means such as nut 64 is then threaded onto bolt 60 for fixedly positioning L-shaped bracket member 44. As seen in FIG. 2, when nut 64 is loosened, L-shaped bracket member 44 may be slid longitudinally along first extending arm 26 with locking tab 52 extending through and sliding in longitudinal slot 36 to the desired position. Nut 58 is then tightened on bolt 60. Similarly extending from second extending arm 28 is L-shaped bracket member 46. L-shaped bracket member 46 has locking tabs 66 and 68 extending normally therefrom. Locking tabs 66 and 68 are adapted for engagement with longitudinal slot 38 and second extending arm 28. L-shaped bracket 46 also has longitudinal bracket slots 70 and 72 formed therein on arm portions 74 and 76 respectively. Locking tabs 66 and 68 are adapted for insertion into and engagement with longitudinal slot 38. L-shaped bracket 46 is attached to second extending arm 28 by means of second fastening means such as bolt 78 which extends through longitudinal bracket slot 70 and longitudinal slot 38. Second gripping means such as nut 80 is then threadedly attached to bolt 78 so as to fixedly position L-shaped bracket 46 relative to second extending arm 28.

Similarly, C-shaped base member 24 has third extending arm 32 and fourth extending arm 34 extending normally from center portion 82. L-shaped bracket 48 is connected to third extending arm 32 by means of a third fastening means such as bolt 94 which extends through longitudinal bracket slot 96 in L-shaped bracket 48 and through longitudinal slot 40 of arm 32. L-shaped bracket 48 has locking tabs 86 and 88 extending normally from the proximal and distal ends 90 and 92 thereof. Third gripping means such as nut 98 is threadedly attached to bolt 94 for fixedly positioning L-shaped bracket 80 to extending arm 32. Again locking tab 86 is inserted in longitudinal slot 40 so as to allow slidable positioning of L-shaped bracket 48 prior to tightening of nut 98 on bolt 94.

L-shaped bracket 50 is attached to fourth extending arm 34 of C-shaped base 24. Again L-shaped bracket 50 has locking tabs 100 and 102 extending normally from their proximal and distal ends 104 and 106 thereof. L-shaped bracket 50 has a longitudinal bracket slot 108 formed therein and adapted for the reception of fourth fastening means such as bolt 110 which may also be extended therethrough. L-shaped bracket 50 is fixedly attached to arm 34 by attachment of fourth gripping means such as nut 112 to bolt 110. As a result, L-shaped brackets 44, 46, 48 and 50 may be slidingly positioned relative to C-shaped bases 22 and 24. The size and positioning of the resulting horizontal platform 200 created by the plane of the four aforesaid L-shaped brackets may thereby be easily adjusted by the user to suit the object being supported.

Returning now to FIG. 1 in the drawings, vertical support member 14, in a preferred embodiment comprises a pair 116 and 118 of substantially tubular columns interconnected by one or more brace members such as brace members 120 and 122. Brace members 124 and 126, in the embodiment shown comprise S-shaped decorative metal strips welded to columns 116 and 118, although such strips could be of any decorative design.

As further seen in FIG. 1 in a preferred embodiment, tubular columns 116 and 118 each comprise two or more substantially tubular members adapted for telescopic engagement in connection with each other. In particular, tubular columns 116 and 118 are telescopically connected to tubular columns 128 and 130. This is accomplished by having the distal ends 132 and 134 of tubular columns 116 and 118 crimped so as to be smaller about their outside diameter than the inside diameter of tubular columns 128 and 130. A snug fitting and secure telescopic connection is thereby provided.

As seen in FIG. 2 of the drawings, C-shaped base members 22 and 24 are fixedly attached to vertical support members 116 and 118 by means of bolts 132 and 134 which extend through C-shaped members 22 and 24 and vertical supports 116 and 118. Nuts 136 and 138 are threadedly attached to bolts 132 and 134 for said fixed positioning. An easily assembled support device is thereby provided.

As shown in FIG. 1 of the drawings, when L-shaped brackets 44, 56, 48 and 50 are laterally arrayed on C-shaped bases 22 and 24 an H-shaped configurations is formed which provides a substantially horizontal base or platform 200 for mailbox 12. Mailbox 12 includes downwardly depending flanges 140 and 142 having apertures 144, 146, 148 and 150 extending therethrough adapted for alignment with longitudinal bracket slots 152, 72, 156 and 158 respectively formed in L-shaped brackets 44, 46, 48 and 50. Bolts 160 and 62, 164 and 166 extend therethrough for connection to the aforesaid downwardly depending flanges. The bolts are also threadedly attached by means of nuts 168, 170, 172 and 174 on their ends.

As best seen in FIG. 6 of the drawings, and mentioned previously, L-shaped bracket 46 has first and second arm portions 74 and 76. In a preferred embodiment arm portion 74 is shorter than arm portion 76 so as to allow a multitude of height and width extensions, and combinations thereof.

As seen in FIG. 7 of the drawings, locking tabs 68 and 100 are also adapted for alignment with bottom edges 169 and 171 of second extending arm 28 and fourth extending arm 34. Bolts 78 and 110 are then extended through longitudinal bracket slots 70 and 108 so as to allow fixed positioning of L-shaped brackets 46 and 50 in a substantially vertical position. Thus, longitudinal slots 72 and 158 are presented in a substantially horizontal configuration adapted for abutment directly against mailbox 12. Consequently a screw or bolt may be inserted therethrough for connection to mailbox 12.

Figure 4:
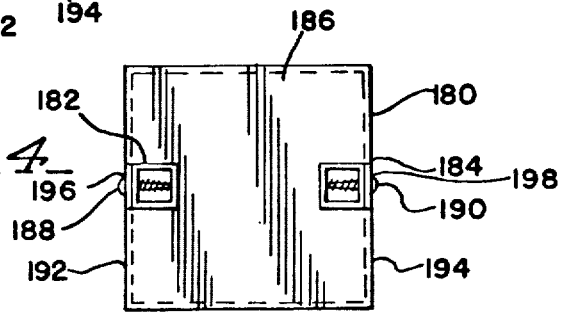
FIG. 4 of the drawings is a bottom view of the support of FIG. 1 of the drawings.

Turning to FIGS. 1 and 4 of the drawings, in a preferred embodiment, mailbox support 10 includes a base 18 for vertical support 14. In a preferred embodiment base 18 comprises a tray 180 adapted for insertion into the ground and reception of filling means such as concrete, mud, sand or stones for fixed positioning of the vertical support 14 and thereby mailbox 12. In a preferred embodiment tray 180 comprises a substantially rectangular open face box. As best seen in FIG. 4, tray 180 includes a pair of apertures 182 and 184 on its bottom surface 186 adapted for insertion of vertical support members 116 and 118. Improved rigidity of the connection between tray 180 vertical supports 116 and 118 is provided. Tray 180 is fixedly attached to vertical supports 116 and 118 by means of sheet metal screws 188, 190, 196 and 198 which extend through side vertical walls 192 and 194 of tray 180 and through vertical supports 116 and 118. Alternatively, nuts and bolts may be utilized for attaching vertical supports 116 and 118 to tray 180. As a result, an easily assembled adjustable support mechanism is provided.

The foregoing description of the drawings merely explain and illustrate the invention and the invention is not so limited thereto so except insofar as those who have the disclosure before them will be able to make modifications and variations therein without departing from the scope of the invention.

What is claimed is:

1. In combination, a rural mailbox in support comprising:

a box member;

vertical support means for supporting said box member;

a base for mounting said vertical support means in the ground;

a pair of said C-shaped base members extending laterally from said vertical support means, each of said pair of said C-shaped base members having a first and second extending arm and each of said first and second extending arms having an L-shaped bracket member attached thereon and adapted for attachment to said box member and one or more longitudinal slots in said extending arms; and, each of said L-shaped bracket members having one or more longitudinal bracket slots formed therein and one or more locking tabs at the proximal and distal ends thereof for insertion into and engagement with said one or more longitudinal slots in said extending arms.

2. The mailbox support of claim 1 and further comprising nut and bolt means for attachment of said one or more C-shaped base members to said vertical support means.

3. The mailbox and support of claim 1 wherein said one or more C-shaped base members and said one or more L-shaped bracket members are constructed and arranged for fixed positioning in a substantially H-shaped configuration extending from said vertical support means, so as to provide a substantially horizontal platform for support of said mailbox.

4. The mailbox and support of claim 1 wherein said mailbox includes downwardly depending flanges having apertures extending therethrough adapted for connection to each L-shaped bracket members.

5. The mailbox and support of claim 1 wherein each L-shaped bracket member includes two arm portions, one of said arm portions being adapted for attachment to one of said C-shaped base member and the other arm portion being adapted for attachment to said box member respectively.

6. The mailbox and support of claim 1 wherein a pair of said C-shaped base members extend laterally from said vertical support means, each of said pair of said C-shaped base members having a first and second extending arm and each of said first and second extending arms having an L-shaped bracket member attached thereon and adapted for attachment to said box member.

7. A mounting bracket for mounting a container to a support structure, said mounting bracket comprising:

a pair of C-shaped base members extending laterally from said support structure, each of said pair of said C-shaped base members having a first and second extending arm and each of said first and second extending arms having an L-shaped bracket member attached thereon and adapted for attachment to said container, each of said C-shaped base members having one or more aperture extending there through, each of said C-shaped base members further having first and second arm portions extending therefrom and one or more longitudinal slots in said first and second arm portions; and, said L-shaped bracket members having one or more longitudinal bracket slots contained therein, said one or more L-shaped bracket members being adapted for abutment against and connection to said C-shaped base members, each of said L-shaped bracket members further having locking tabs extending normally therefrom at the proximal and distal ends thereof, said locking tabs being adapted for insertion into and engagement with said one or more longitudinal slots in said first and second extending arms of said C-shaped base members.

8. The mounting bracket of claim 7 and further comprising connecting means for connecting said C-shaped base to said support structure.

9. The mounting bracket of claim 8 wherein each L-shaped bracket member has a first arm and a second arm portion, said first arm portion being longer than said second arm so as to allow a variety of support positoins for said bracket.

10. The mounting bracket of claim 9 wherein said second arm portion of each L-shaped bracket member extends substantially horizontally and has a longitudinal slot formed therein, said longitudinal slot being adapted for reception of said connecting means through each L-shaped bracket member.

11. The mounting bracket of claim 7 wherein said locking tab members may be extended through said one or more apertures in said C-shaped base member and fixedly attached thereto.

12. The mounting bracket of claim 7 and further including nut and bolt means for threaded attachment of said one or more L-shaped bracket members to said C-shaped base member.

13. An adjustable bracket mechanism comprising a pair of C-shaped base members extending laterally from each other, each of said pair of said C-shaped base members having a first and second extending arm and each of said first and second extending arms having an L-shaped bracket member attached thereon, each of said first and second extending arms having one or more longitudinal slots formed therein; and, said L-shaped bracket members having locking tabs extending from the proximal and distal ends thereof and adapted for insertion into said one or more longitudinal slots in said C-shaped base members and attachment thereto, said L-shaped bracket members further having longitudinal bracket slots formed therein adapted for reception of one or more bolts so as to allow selective attachment of said L-shaped bracket members to said C-shaped base members.

14. The adjustable bracket of claim 13 wherein said locking tabs are adapted for abutment against the bottom edge of one of said first and second extending arms of said C-shaped base member so as to allow fixed positioning of said one or more L-shaped bracket member in a vertical position relative to one of said first and second extending arms.

15. An adjustable platform mechanism comprising:

two or more C-shaped members interconnected along their bases and having first and second arms extending from each of said C-shaped members and oppositely from each other, and having one or more longitudinal slots in each of said arm portions;

one or more L-shaped members having one or more apertures contained therein, said one or more L-shaped members being adapted for abutment against and connection to said arms of said C-shaped member, said one or more L-shaped members having locking tabs exending normally therefrom at the proximal and distal ends thereof, said locking tabs being adapted for insertion into and engagement with said longitudinal slots in said arm portions of said C-shaped members; and, connecting means for selectively attaching said one or more L-shaped members to said C-shaped members in a variety of positions.

16. In combination, a rural mailbox and support comprising:

a box member;

vertical member support means for supporting said box member;

a base for mounting said vertical support means in the ground;

a pair of C-shaped base members extending laterally from said vertical support means, each of said pair of said C-shaped base members having a first and second extending arm and each of said first and second extending arms having one or more longitudinal slots and an L-shaped bracket member attached thereon and adapted for attachment to said box member; and, each of said L-shaped bracket members having one or more longitudinal bracket slots formed therein and one or more locking tabs at the proximal and distal ends thereof for insertion into and engagement with said one or more longitudinal slots in said extending arms.

* * * * *

UNITED STATES PATENT AND TRADEMARK OFFICE

CERTIFICATE OF CORRECTION

PATENT NO. : 4,709,853

DATED : December 1, 1987

INVENTOR(S) : Ronald R. Hahn

It is certified that error appears in the above-identified patent and that said Letters Patent is hereby corrected as shown below:

Column 2, Line 10, change "Whle" to --While--;

Column 4, Line 7, change "62" to --162--;

Claim 9, Line 5, change "positoins" to --positions--; and

Claim 15, Line 13, change "exending" to --extending--.

Signed and Sealed this

Twenty-first Day of June, 1988

*Attest:*

DONALD J. QUIGG

*Attesting Officer*

*Commissioner of Patents and Trademarks*